US006644783B1

(12) United States Patent
Tsuruoka

(10) Patent No.: US 6,644,783 B1
(45) Date of Patent: Nov. 11, 2003

(54) PRINTING APPARATUS AND PRINTING METHOD

(75) Inventor: Yuji Tsuruoka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/618,482

(22) Filed: Jul. 18, 2000

(30) Foreign Application Priority Data

Jul. 19, 1999 (JP) ..... 11-204957

(51) Int. Cl.[7] ..... B41J 2/15
(52) U.S. Cl. ..... 347/41; 347/40
(58) Field of Search ..... 347/12, 14, 15, 347/40, 41, 43, 145, 211, 237, 16

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/97 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,359,355 A | * | 10/1994 | Nagoshi et al. | 347/9 |
| 5,847,721 A | * | 12/1998 | Ogata et al. | 347/41 |
| 5,917,519 A | * | 6/1999 | Arai et al. | 347/41 |
| 6,086,184 A | | 7/2000 | Iwasaki et al. | 347/40 |

FOREIGN PATENT DOCUMENTS

| | | |
|---|---|---|
| EP | 0 518 670 | 12/1992 |
| EP | 0 526 205 | 2/1993 |
| EP | 0 982 143 | 3/2000 |
| JP | 54-56847 | 5/1979 |
| JP | 59-123670 | 7/1984 |
| JP | 59-138467 | 8/1984 |
| JP | 60-71260 | 4/1985 |
| JP | 61-120578 | 6/1986 |

* cited by examiner

*Primary Examiner*—Lamson Nguyen
(74) *Attorney, Agent, or Firm*—Fitzpatrick, Cella, Harper & Scinto

(57) ABSTRACT

A printing apparatus and printing method for improving printing speed in multi-pass printing without increasing the capacity of a printer power source while utilizing a conventional printhead. A plurality of printing elements of the printhead is divided into a plurality of blocks; different blocks are selected from the plurality of blocks for each scan of the multi-pass printing; printing elements included in the selected block are time-divisionally driven; and moving speed of the carriage is increased in accordance with the number of times of scans in multi-pass printing. In multi-pass printing, for instance, in a case where the number of blocks selected for each scan of multi-pass printing is one half of the total number of blocks, the moving speed of the carriage is doubled, thereby achieving high-quality image printing while maintaining high speed of the printing.

23 Claims, 20 Drawing Sheets

| NUMBER OF PASSES | DRIVING PATTERN | BLOCK SEQUENCE |
|---|---|---|
| 1 | 1-1 | 0 1 2 3 4 5 6 7 8 9 10 11 |
| 2 | 2-1 | 0 2 4 6 8 10 |
| | 2-2 | 1 3 5 7 9 11 |
| 3 | 3-1 | 0 3 6 9 |
| | 3-2 | 1 4 7 10 |
| | 3-3 | 2 5 8 11 |
| 4 | 4-1 | 0 4 8 |
| | 4-2 | 1 5 9 |
| | 4-3 | 2 6 10 |
| | 4-4 | 3 7 11 |

FIG. 7

| NUMBER OF PASSES | DRIVING PATTERN | BLOCK SEQUENCE |
|---|---|---|
| 1 | 1-1 | 0 1 2 3 4 5 6 7 8 9 10 11 |
| 2 | 2-1 | 0 2 4 6 8 10 |
| | 2-2 | 1 3 5 7 9 11 |
| 3 | 3-1 | 0 3 6 9 |
| | 3-2 | 1 4 7 10 |
| | 3-3 | 2 5 8 11 |
| 4 | 4-1 | 0 4 8 |
| | 4-2 | 1 5 9 |
| | 4-3 | 2 6 10 |
| | 4-4 | 3 7 11 |

FIG. 11A

| Y | M | C | Bk |
|---|---|---|---|
| 4-1 | 4-1 | 4-1 | 4-1 |
| 4-3 | 4-3 | 4-3 | 4-3 |
| 4-4 | 4-4 | 4-4 | 4-4 |
| 4-2 | 4-2 | 4-2 | 4-2 |

MAIN-SCANNING DIRECTION

FIG. 11B

| | | | |
|---|---|---|---|
| 4-3 | 4-3 | 4-3 | 4-3 |
| 4-4 | 4-4 | 4-4 | 4-4 |
| 4-2 | 4-2 | 4-2 | 4-2 |
| 4-1 | 4-1 | 4-1 | 4-1 |

FIG. 11C

| | | | |
|---|---|---|---|
| 4-4 | 4-4 | 4-4 | 4-4 |
| 4-2 | 4-2 | 4-2 | 4-2 |
| 4-1 | 4-1 | 4-1 | 4-1 |
| 4-3 | 4-3 | 4-3 | 4-3 |

FIG. 11D

| | | | |
|---|---|---|---|
| 4-2 | 4-2 | 4-2 | 4-2 |
| 4-1 | 4-1 | 4-1 | 4-1 |
| 4-3 | 4-3 | 4-3 | 4-3 |
| 4-4 | 4-4 | 4-4 | 4-4 |

PRINTING APPARATUS AND PRINTING METHOD

FIELD OF THE INVENTION

The present invention relates to a printing apparatus and printing method, and more particularly, to a printing apparatus for performing printing by discharging an ink droplet on a printing medium.

BACKGROUND OF THE INVENTION

Currently, printing apparatuses that require high-speed and high-precision printing mainly employ an ink-jet printing method. A printhead used in such printing apparatuses generally has an array of plural nozzles for discharging ink. Ink discharging techniques include a method of applying foaming energy generated when heaters in the nozzles are driven, or a method of applying contraction of piezoelectric devices provided in the nozzles, and so forth. In either of these methods, disadvantages are brought about when all nozzles are simultaneously driven: for instance, deteriorated printing quality caused by an influence of crosstalk between nozzles, or a large-capacity power source required for temporarily supplying a large electric current. Therefore, many printing apparatuses employ a method (time-divisional driving method) in which all nozzles are divided into blocks, each having a number of nozzles, and the blocks of nozzles are driven while sequentially shifting the block to be driven.

The amount of ink discharged by nozzles of a printhead varies because of an uneven formation of nozzles. If printing is performed with such nozzles, some degree of density unevenness is generated in an image. Therefore, to realize high-precision printing, as disclosed in Japanese Patent Application Laid-Open No. 61-120578, each image area is overlappingly printed by plural scans (multi-pass printing) instead of printing an image by a single scan, and ink is randomly discharged from various parts of the nozzle array to form an image, thereby reducing the density unevenness.

However, to satisfy the recent demand for high printing speed, i.e., improved throughput, the driving cycle of the block in the time-divisional method has conventionally been reduced. However, to assure the minimum time necessary for driving discharge heaters and generating enough foaming energy, the driving cycle of the block can no longer be reduced. In addition, the so-called multi-pass printing, in which one area is printed complementarily by a plurality of scanning operations to realize high-precision printing, requires as much time as the number of scans (the number of passes). As a result, the printing speed is further deteriorated.

SUMMARY OF THE INVENTION

The present invention has been proposed to solve the conventional problems, and has as its object to provide a printing apparatus and printing method employing a conventional printhead, which can improve printing speed while maintaining high printing quality without requiring a large-capacity power source.

Another object of the present invention is to provide a printing apparatus and printing method which can achieve improved printing speed when color printing or high-precision printing is performed by multi-pass printing.

A further object of the present invention is to provide a printing apparatus and printing method which realize high-speed printing while maintaining high printing quality when multi-pass printing is performed with a plurality of printheads.

In order to attain the above objects, the present invention provides a printing apparatus for printing an image on a print medium by scanning a carriage, having at least one printhead including a plurality of printing elements, and performing multi-pass printing in which one area is printed complementarily by a plurality of scans, said printing apparatus comprising: division means for dividing the plurality of printing elements into a plurality of blocks; selection means; and control means for controlling moving speed of the carriage in accordance with a number of scans in the multi-pass printing.

Furthermore, in order to attain the above objects, the present invention also provides a printing method for printing an image on a print medium by scanning a carriage, having at least one printhead including a plurality of printing elements, and performing multi-pass printing in which one area is printed complementarily by a plurality of scans, said printing method comprising the steps of: dividing the plurality of printing elements into a plurality of blocks; selecting a different block from the plurality of blocks for each scan of the multi-pass printing; time-divisionally driving printing elements included in the selected block; and controlling moving speed of the carriage in accordance with a number of scans in the multi-pass printing.

More specifically, a plurality of printing elements in a printhead are divided into a plurality of blocks, different blocks are selected from the plurality of blocks for each pass of multi-pass printing, the printing elements of the selected blocks are time-divisionally driven, and moving speed of a carriage is controlled in accordance with the number of passes in multi-pass printing.

By virtue of this, for instance, in a case where the number of selected blocks for printing each pass of multi-pass printing is one half of the total number of blocks, the carriage moving speed is doubled to maintain high printing speed while achieving high-quality image printing. In addition, since the number of printing elements driven at once is controlled to a small number, it is possible to use a conventional printhead, and moreover, it is possible to prevent an increased cost and weight of a printing apparatus due to an increased capacity of a power source.

In this case, by transferring image data in correspondence with carriage movement, a storage device, e.g., mask ROM or the like, for obtaining sampling data for each block to be driven becomes unnecessary. Accordingly, the overall cost of the printing apparatus can be cut down.

Furthermore, since block selection is controlled such that all of a plurality of blocks are driven each time printing is performed by scanning the carriage the same number of times as the number of passes in multi-pass printing, all printing elements are driven the same number of times in the same cycle. Therefore, when performing high-speed printing, the usage frequency of each printing element can be kept equal, thus preventing a shortened life cycle of the printhead and reduced printing quality due to uneven performance of the printing elements.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 is a table showing driving patterns in multi-pass printing;

FIGS. 11A to 11D are explanatory views of print areas in the main-scanning direction and driving patterns when performing color image printing;

DETAILED DESCRIPTION OF THE PREFERRED EMBODIMENTS

Preferred embodiments of the present invention will now be described in detail in accordance with the accompanying drawings.

Figure 1:
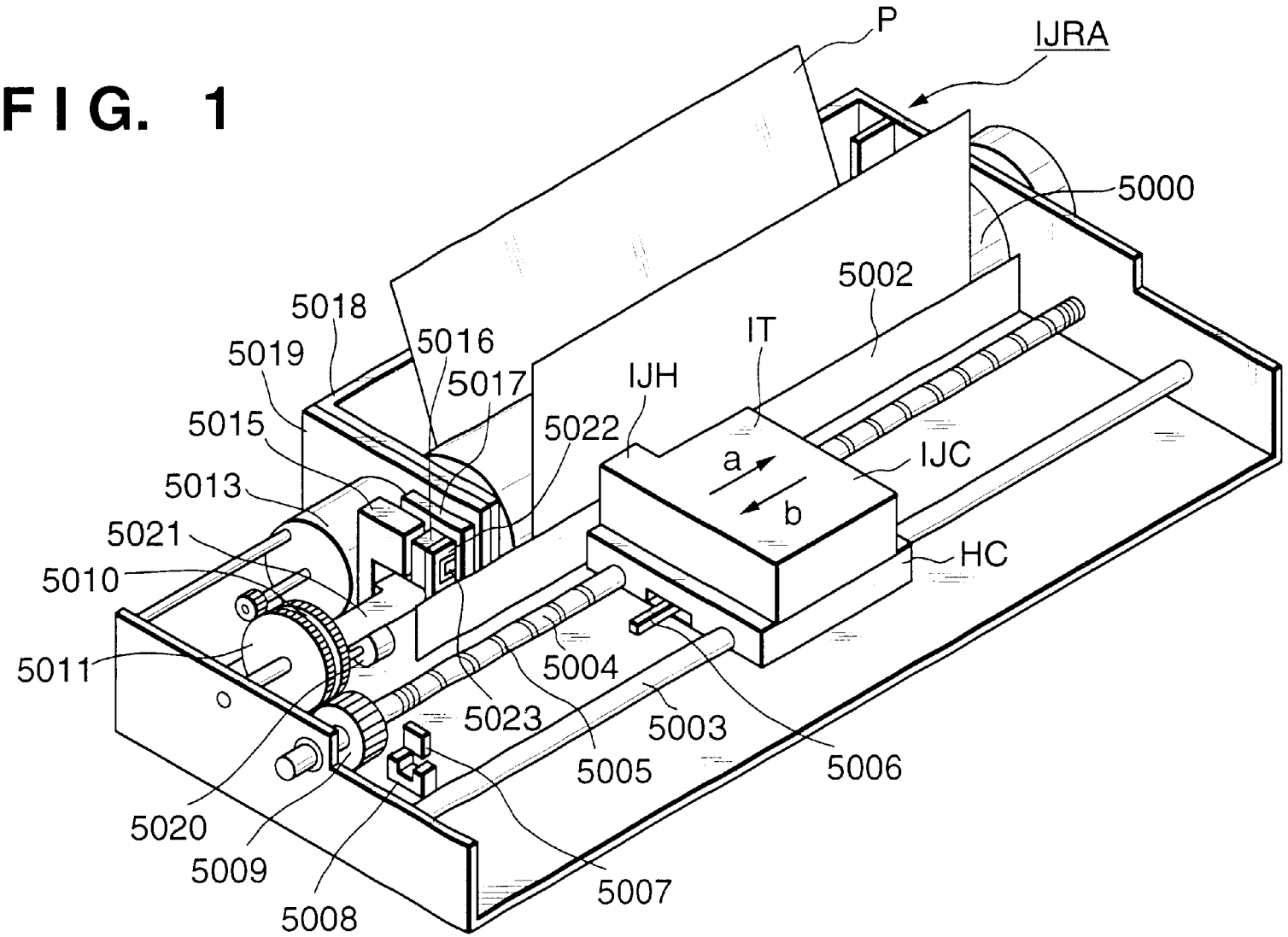
FIG. 1 is a perspective view showing an outer appearance of the construction of a printing apparatus according to the present invention.

FIG. 1 is a perspective view showing an outer appearance of the construction of an ink-jet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b while being supported by a guide rail 5003. An integrated ink cartridge IJC, incorporating a printhead IJH and an ink tank IT, is mounted on the carriage HC. Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and are used for switching, e.g., the rotating direction of the motor 5013. Reference numeral 5016 denotes a member for supporting a cap member 5022, which caps the front surface of the printhead IJH; and 5015, a suction device for sucking ink residue inside the cap member. The suction device 5015 performs suction recovery of the printhead through an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the region of the home-position. However, the present invention is not limited to this arrangement as long as desired operations are performed at known timings.

Figure 2:
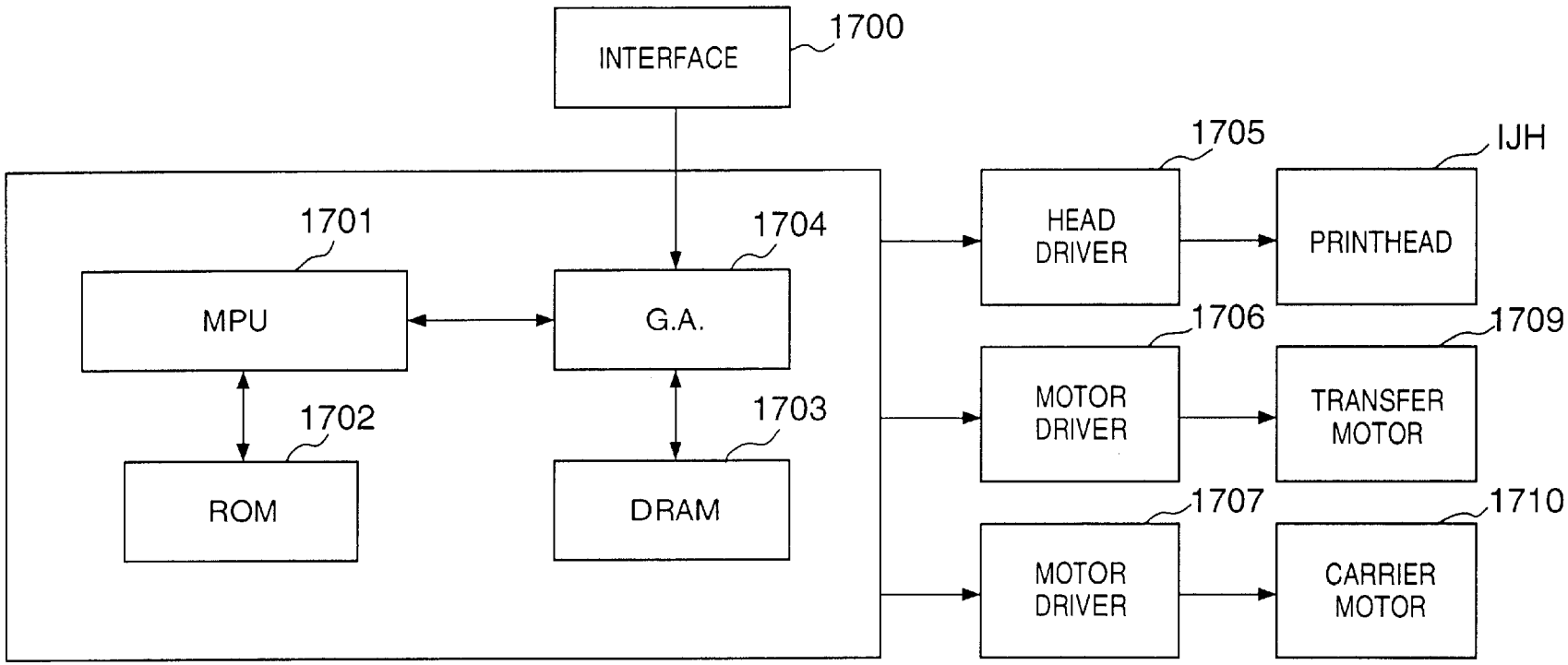
FIG. 2 is a block diagram showing an arrangement of a control circuit of the printing apparatus shown in FIG. 1.

Next, description will be provided on the control circuit for executing print control of the above-described printing apparatus. FIG. 2 is a block diagram showing an arrangement of a control circuit of the ink-jet printer IJRA. Referring to FIG. 2 showing the control circuit, reference numeral 1700 denotes an interface for inputting a print signal; 1701, an MPU; 1702, ROM for storing a control program executed by the MPU 1701; and 1703, DRAM for storing various data (aforementioned print signals, or print data supplied to the printhead IJH, and the like). Reference numeral 1704 denotes a gate array (G.A.) for controlling the supply of print data to the printhead IJH. The gate array 1704 also performs data transfer control among the interface 1700, the MPU 1701, and the DRAM 1703. Reference numeral 1710 denotes a carrier motor for conveying the printhead IJH; and 1709, a transfer motor for transferring a print medium. Reference numeral 1705 denotes a head driver for driving the printhead IJH; and 1706 and 1707, motor drivers for driving the transfer motor 1709 and the carrier motor 1710 respectively.

The operation of the aforementioned control structure is now described. When a print signal is inputted to the interface 1700, the print signal is converted to print data by the gate array 1704 and MPU 1701 intercommunicating with each other. As the motor drivers 1706 and 1707 are driven, the printhead IJH is driven in accordance with the print data transferred to the head driver 1705, thereby performing printing.

Note that the ink tank IT and printhead IJH may be integrally structured to constitute the exchangeable ink cartridge IJC as described above, or may be configured separably so as to allow exchange of only the ink tank IT when ink is exhausted.

Figure 3:
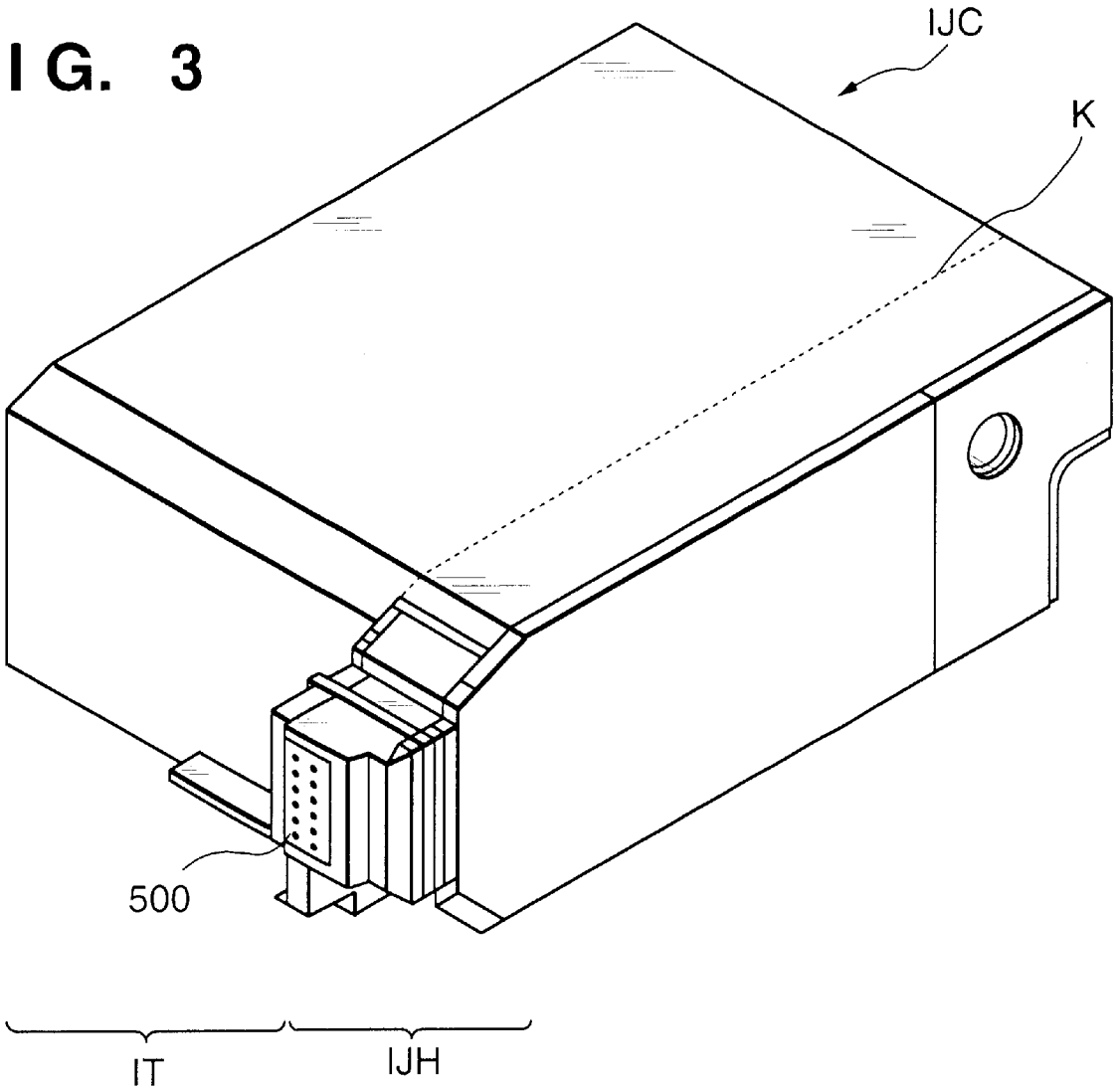
FIG. 3 is a perspective view showing an outer appearance of an ink cartridge of the printing apparatus shown in FIG. 1.

FIG. 3 is a perspective view showing an outer appearance of the ink cartridge IJC where the printhead IJH and ink tank IT are separable.

In the ink cartridge IJC shown in FIG. 3, the printhead IJH can be separated from the ink tank IT at the boundary line K. The ink cartridge IJC includes an electrical contact portion (not shown) so that the ink cartridge IJC receives electrical signals from the carriage HC when mounted on the carriage HC. The printhead IJH is driven by the received electrical signals as described before.

Note in FIG. 3, reference numeral 500 denotes an array of ink discharge orifices. The ink tank IT includes a fibrous or porous ink absorbing member for maintaining ink.

Furthermore, the printhead IJH may be of a printhead for printing a black-and-white image by discharging black ink, or may be of a printhead for printing a color image by discharging cyan, magenta, yellow and black ink.

Next, a printhead employed by the present embodiment is described.

Figure 5:
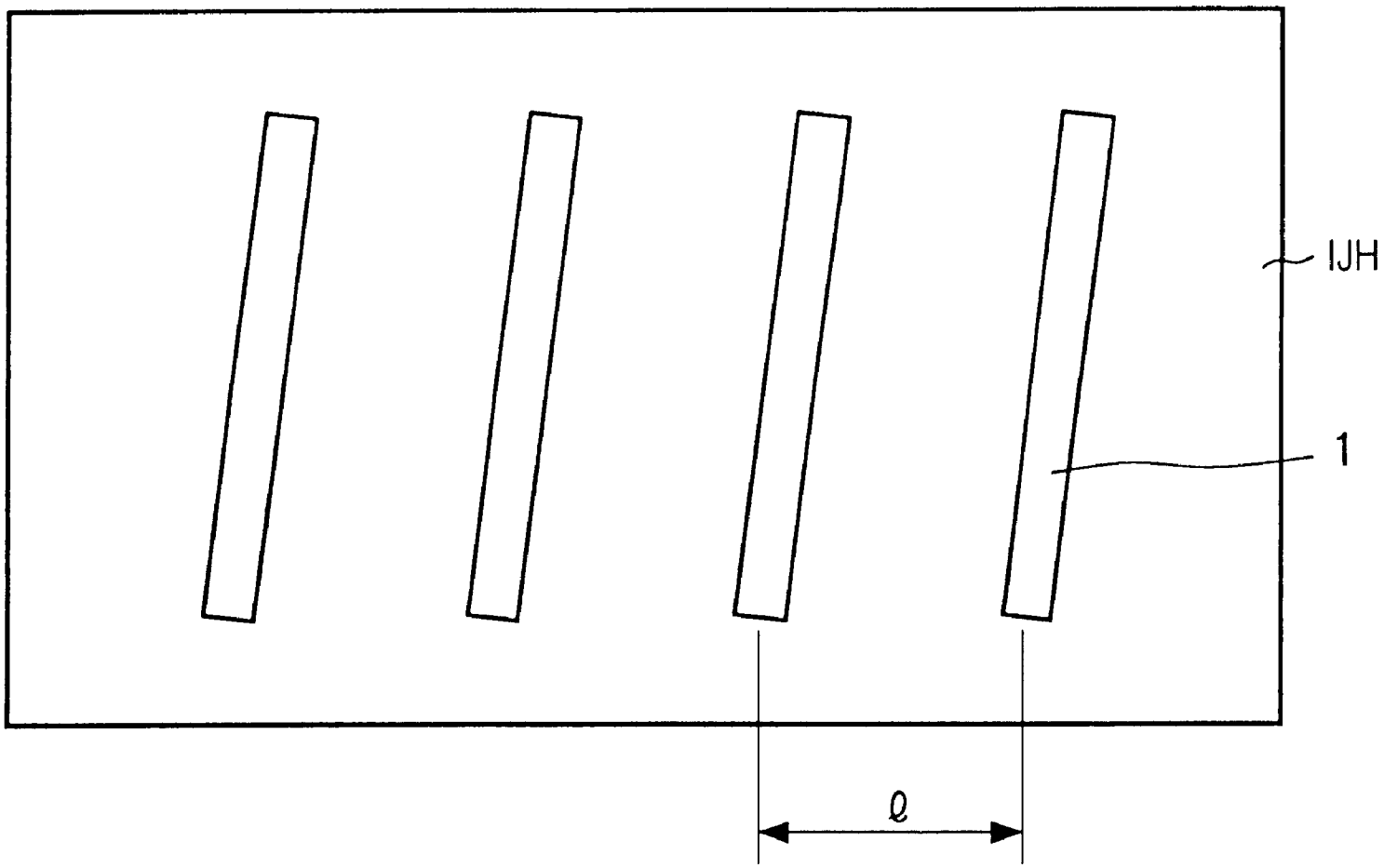
FIG. 5 is a structural view of a printhead according to the embodiment of the present invention.

FIG. 5 is a front view of a color printhead mounted on the printing apparatus according to the present embodiment. In FIG. 5, nozzle arrays 1, provided for yellow (Y), magenta (M), cyan (C), and black (Bk), are arranged at predetermined intervals l in the main-scanning (horizontal) direction of the carriage, and form the printhead IJH. Each of the four nozzle arrays has 192 nozzles, and an ink discharge frequency of each nozzle is 10 kHz in normal driving. The amount of ink discharged from each of the nozzles, discharging Y, M and C respectively, is the same. The amount of ink discharged from the nozzle discharging Bk is about twice as much as the aforementioned amount of Y, M or C. Besides the amount of discharge, the four nozzles have the same configuration.

Hereinafter, the construction of a logic circuit of the printhead and printing method are described with reference to FIGS. 6, 8, 9A and 9B.

Figure 8:
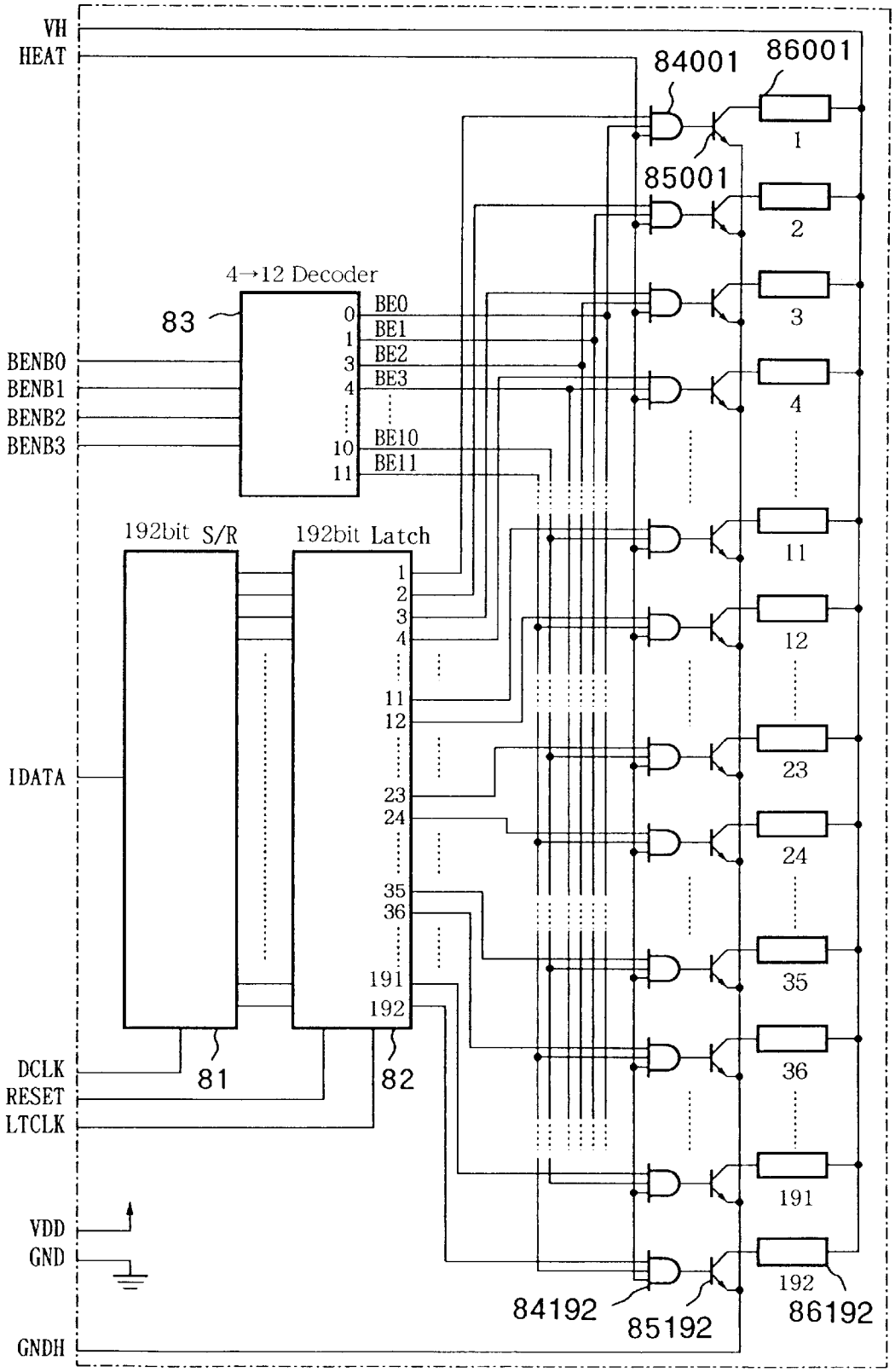
FIG. 8 is a block diagram showing a logic circuit of the printhead.

FIG. 8 is a block diagram showing a logic circuit of the printhead. The logic circuit, provided for each nozzle array, comprises: a 192-bit shift register 81 for sequentially outputting image data IDATA bit by bit, which is input in synchronization with data clock DCLK; a 192-bit latch 82 for maintaining a bit signal input from the shift register during the cycle of the latch clock LTCLK and outputting the bit signal from each of 192 output terminals; and a decoder 83 for converting a block selection signal (4-bit signal including BENB0 to BENB3) to a signal designating each of twelve blocks BE0 to BE11. The logic circuit also comprises, for each of the 192 nozzles, heaters 86001 to 86192 constituting printing elements, power transistors 85001 to 85192 for driving the heaters, and AND gates 84001 to 84192 which AND the output of the decoder 83, output of the latch 82, and heat signal HEAT, for outputting a driving signal of each power transistor.

Figure 9A:
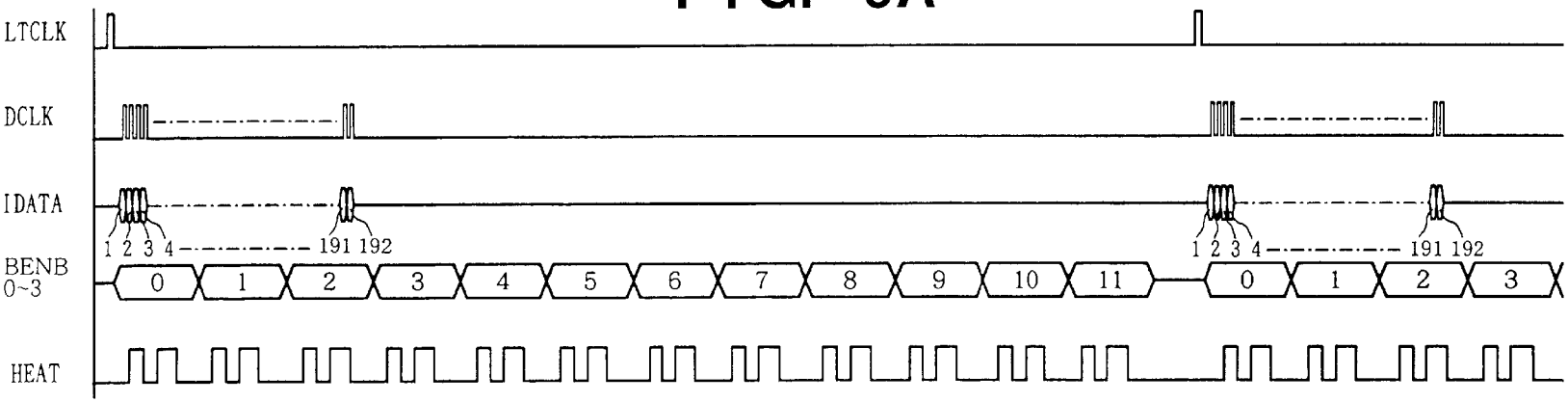
FIGS. 9A and 9B are timing charts of signals shown in FIG. 8 for performing 1-pass printing and 4-pass printing respectively.

FIG. 9A is a timing chart for performing 1-pass printing by time-divisionally driving each block of nozzle arrays by the logic circuit having the above-described construction. In FIG. 9A, LTCLK, DCLK, IDATA, BENB0 to BENB3, and HEAT respectively denote the latch clock, data clock, image data, decoder input, and heat signal shown in FIG. 8. 192-bit image data is temporarily registered in the shift register 81 in synchronization with the data clock DCLK, and when latch clock LTCLK is input, the image data is transferred to the latch 82 and output to the 192 respective output terminals of the latch 82. Meanwhile, the block selection signals BENB0 to BENB3 are decoded to BE0 to BE11 by the decoder 83 and the AND gate ANDs the output of the decoder 83, heat signal HEAT, and output of the latch 82. Then, heaters connected to the power transistors which have received a driving signal from the AND gates are energized. As a result of this operation, ink is discharged from the nozzles and printing is performed.

As can be seen from the timing chart, compared to the time required for transferring 192 bits of image data IDATA for all nozzles, the time required for driving all nozzles at twelve divisional timings is extremely longer. This is due to the fact that the image data transfer frequency is 10 MHz and the time required for transferring image data for 192 nozzles is approximately 20 $\mu$s, whereas the time required for driving the aforementioned heaters to obtain sufficient foaming energy is 3 to 8 $\mu$s and for twelve divisional driving operation, approximately 100 $\mu$s which is quite long.

Figure 6:
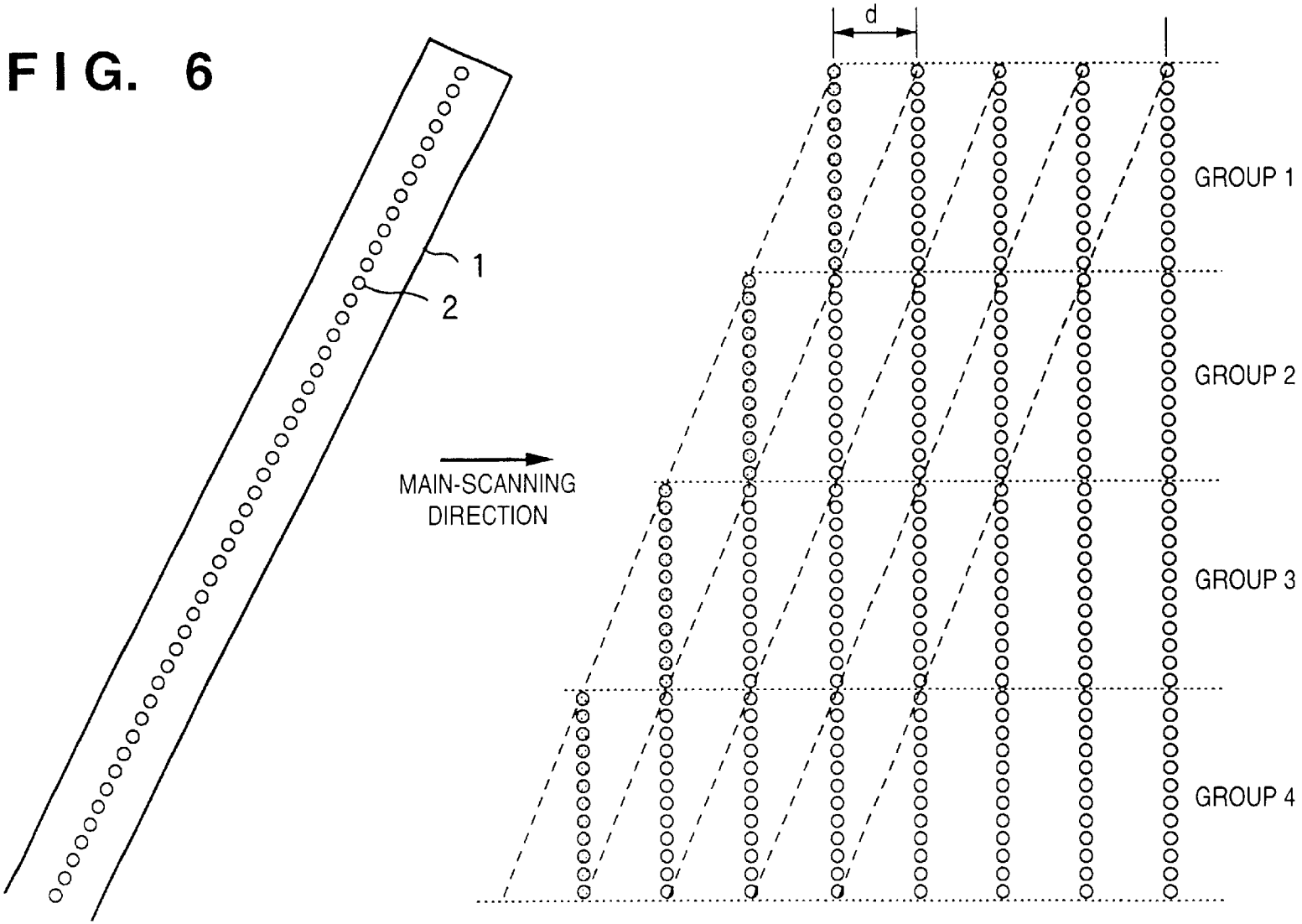
FIG. 6 shows an arrangement of print dots obtained by 1-pass printing according to the embodiment of the present invention.

FIG. 6 shows an arrangement of print dots obtained when printing is performed by time-divisionally driving each block. For simple description, FIG. 6 only shows 48 nozzles and omits 49th and subsequent nozzles. The logic circuit employed in the present embodiment is constructed by 16 groups of nozzles, each group having 12 nozzles. The nozzles 2 are divided into 16 groups for every 12 nozzles from the top of the drawing (FIG. 6).

Furthermore, the nozzles are divided into 12 blocks, Block 0 to Block 11, wherein Block 0 is constructed with the first nozzle of each group, i.e., $1^{st}$, $13^{th}$, $25^{th}$, . . . , and $181^{st}$ nozzles (sixteen nozzles), and Block 11 is constructed with the twelfth nozzle of each group, i.e., $12^{th}$, $24^{th}$, $36^{th}$, . . . , and $192^{nd}$ nozzles (sixteen nozzles). In order to drive the nozzles in each block unit, heaters incorporated in the nozzles that belong to the same block are connected to the same output terminal of the decoder 83 through the AND gates 84001 to 84192 as shown in the circuit diagram of FIG. 8. These blocks 0 to 11 are time-divisionally driven as shown in FIG. 9A.

In such time-divisional driving operation, if the nozzle array of the printhead is moved while being arranged perpendicular to the moving direction of the printhead (main-scanning direction), vertical lines are printed at an angle. To compensate for this, as shown in FIG. 6, the nozzle array 1 is arranged at a predetermined angle with respect to the main-scanning direction so that the vertical lines are substantially orthogonal to the main-scanning direction. As a result, when all nozzles of the nozzle array complete a discharging operation, each group of nozzles ends up printing different columns.

Next, description is provided on a case of performing multi-pass printing according to the present embodiment, in which one area is printed complementarily by a plurality of scanning operations.

Figure 9B:
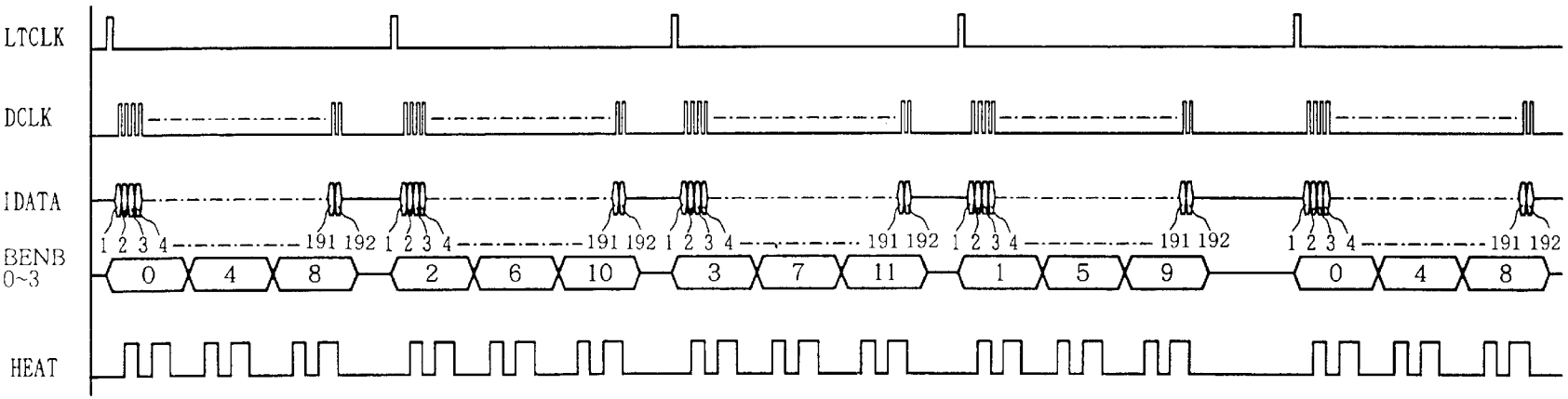
Figure 10A:
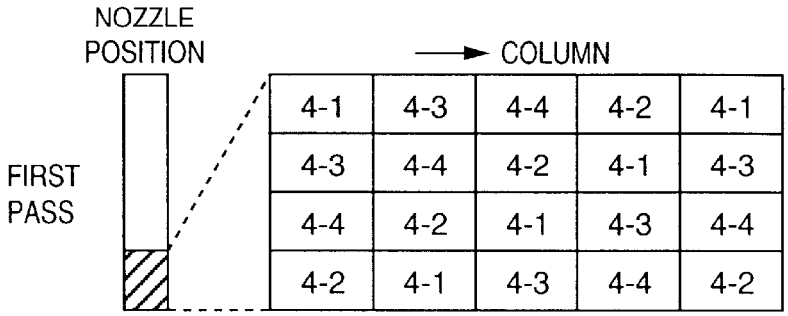
FIGS. 10A to 10D are explanatory views of nozzle positions and driving patterns in each pass of 4-pass printing.
Figure 10B:
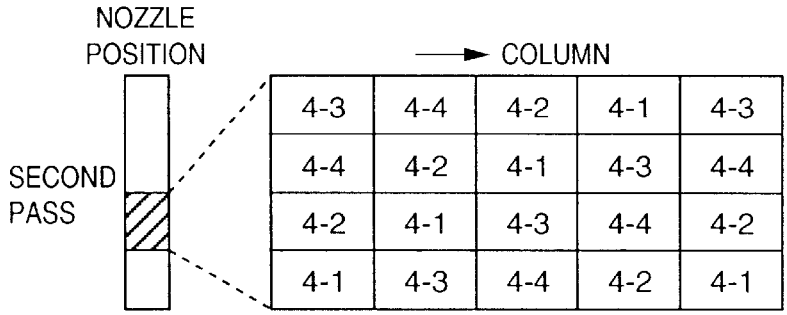
Figure 10C:
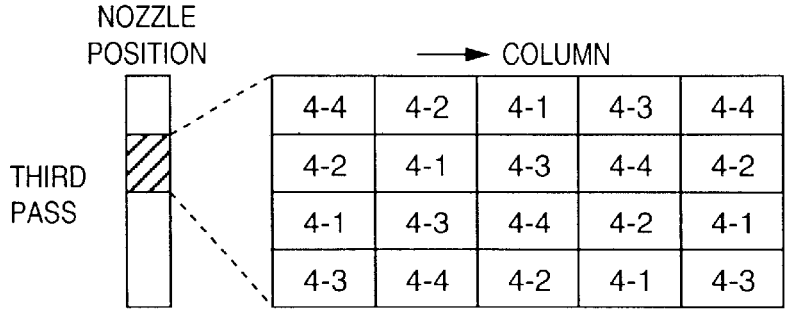
Figure 10D:
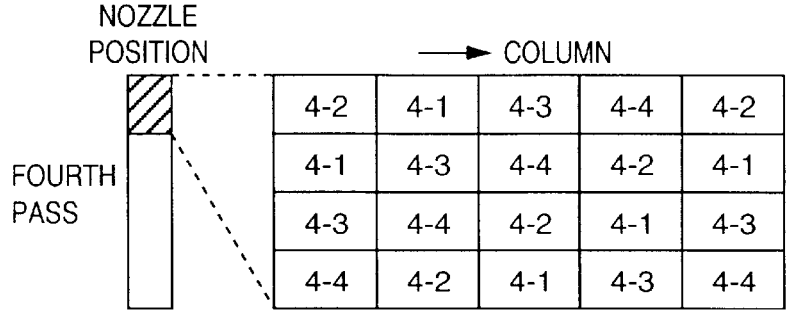

FIG. 9B is a timing chart for performing 4-pass printing (complementary printing by four scanning operations). Similar to FIG. 9A, LTCLK, DCLK, IDATA, BENB0 to BENB3, and HEAT in FIG. 9B respectively denote the latch clock, data clock, image data, decoder input, and heat signal shown in FIG. 8. 192-bit image data is temporarily registered in the shift register 81 in synchronization with the data clock DCLK, and when latch clock LTCLK is input, the image data is transferred to the latch 82 and output respectively to the 192 output terminals of the latch 82. Meanwhile, the block selection signals BENB0 to BENB3 are decoded to BE0 to BE11 by the decoder 83 and the AND gate ANDS the output of the decoder 83, heat signal HEAT, and output of the latch 82. Then, heaters connected to the power transistors which have received a driving signal from the AND gates are energized. As a result of this operation, ink is discharged from the nozzles and printing is performed.

As can be seen from the timing chart, in FIG. 9A showing the driving timing of 1-pass printing, all twelve blocks are driven in single print-data transfer, whereas in FIG. 9B, only three blocks are driven. The combination of three blocks driven are changed sequentially from blocks 0, 4 and 8 to blocks 2, 6 and 10, then to blocks 3, 7 and 11, then to blocks 1, 5 and 9, thus changing the driving pattern. All twelve blocks are driven in each of four print-data transfer operations. Unlike FIG. 9A, the data clock DCLK and image data IDATA are output each time the three blocks to be driven are changed in FIG. 9B. However, this does not cause any problems in terms of time because the time required for transferring 192 bits of image data IDATA for all nozzles is much shorter than the time required for driving the nozzles at three divisional timings.

Figure 4:
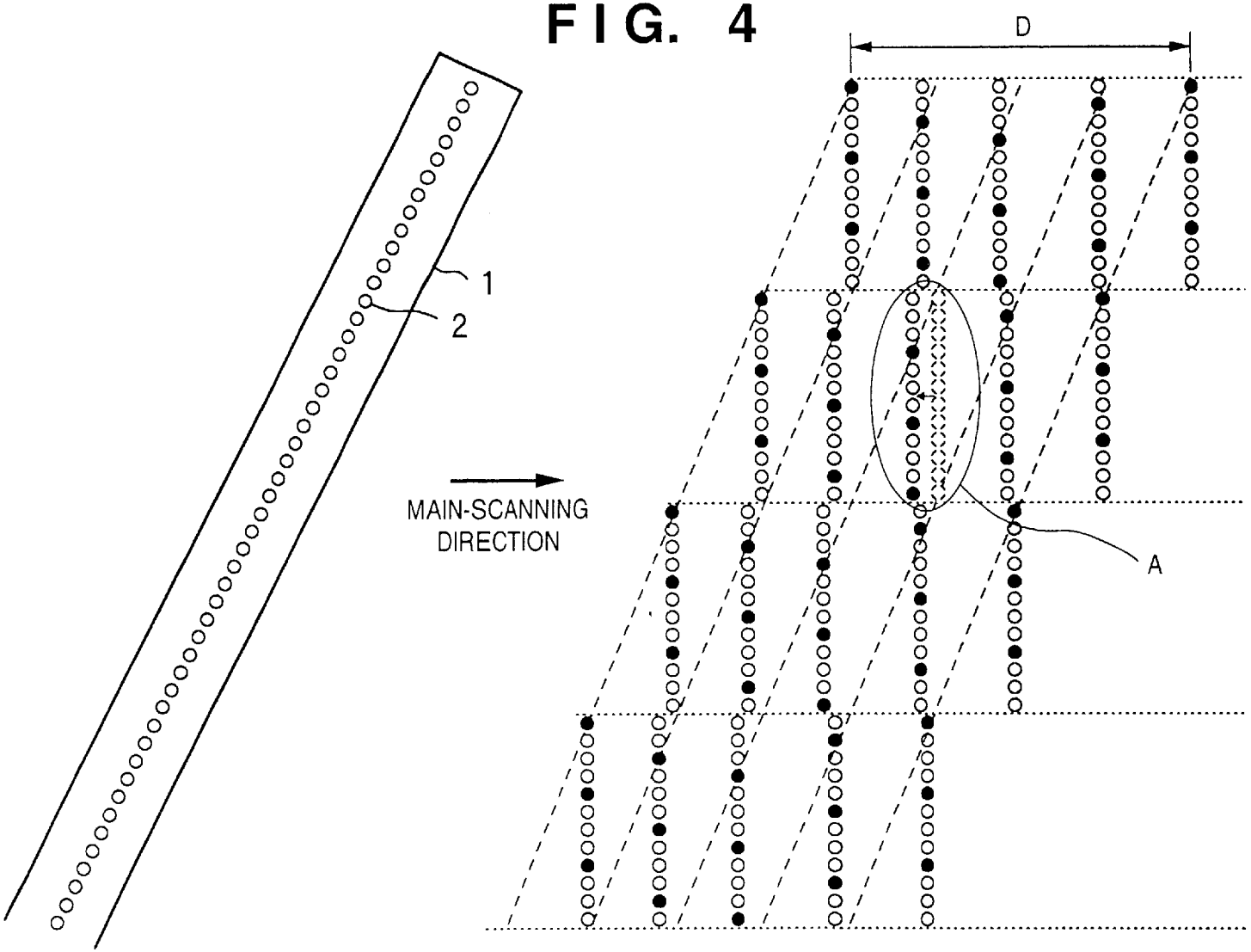
FIG. 4 shows an arrangement of print dots obtained by multi-pass printing according to an embodiment of the present invention.

FIG. 4 shows an arrangement of print dots obtained when printing is performed according to the timing chart of FIG. 9B. Black dots in FIG. 4 indicate printed dots. Since a dot pattern printed by a single pass is ¼ of the entire image, the printed dot pattern shown in FIG. 4 is a 25% of the image randomly thinned out. Note in FIG. 4, although there are dots, such as those indicated by A, that seem significantly displaced in the main-scanning direction from the original positions, in reality, the displacement is equivalent to ¼ of the resolution pitch at most. Therefore, such displacement does not cause any problems in image formation.

As is apparent from the comparison between the driving timing in FIG. 9A and FIG. 9B, in order to print the same number of dots as the number of dots printed while the printhead moves one column in 1-pass printing as shown in FIG. 6, the printhead which performs 4-pass printing shown in FIG. 4 needs to perform printing by moving four columns. In order not to decrease printing speed, when 4-pass printing is performed, the carriage is moved four times as fast as that of 1-pass printing. More specifically, the carriage moving speed is increased by controlling the number of revolutions of the carrier motor 1710 such that the time required by the carriage to move the distance d (FIG. 6) in 1-pass printing becomes equal to the time required by the carriage to move the distance D (FIG. 4) in 4-pass printing.

Normally, if the carriage moves at quadruple speed, the discharge frequency of each nozzle should also quadruple. However, as can be seen in FIG. 4, one nozzle is driven only once every four columns. Therefore, the discharge frequency of each nozzle does not change from that of FIG. 9A. Thus, the discharge performance required for each nozzle is the same as that of the normal printing operation.

Furthermore, the conventional 4-pass printing has required print-image thinning processing to obtain print data for each pass. On the contrary, in the 4-pass printing according to the present embodiment, one quarter (48 bits) of the image data having 192 bits, which is stored in the shift register 81, is selected for each pass and time-divisional printing is performed based on the selected 48-bit data. Therefore, the print-image thinning processing is not necessary. By virtue of this, a storage device, e.g., mask ROM or the like, necessary to obtain sampling data for each pass in the conventional multi-pass printing is no longer necessary. As a result, the overall cost of the printing apparatus can be cut down.

Furthermore, when the transfer clock (DCLK) is 10 MHz, the data transfer time for 192 bits is 19 $\mu$s. Thus, a problem does not arise even if the discharge frequency is quadrupled to 40 kHz (25 $\mu$s).

Note in the foregoing embodiment, although 4-pass printing is described as an example, when other multi-pass printing is performed, the driving pattern of the printhead is changed according to the table shown in FIG. 7. More specifically, when 2-pass printing is performed, the even-numbered blocks and odd-numbered blocks are alternately driven. When 3-pass printing is performed, the combination of four blocks driven is changed sequentially from blocks 0, 3, 6 and 9, to blocks 1, 4, 7 and 10, and to blocks 2, 5, 8 and 11, then the three combinations of blocks are cyclically driven.

In FIG. 7, the driving pattern 1-1 indicates a driving pattern of 1-pass printing where all blocks are time-divisionally driven; driving patterns 2-1 and 2-2 respectively indicate a driving pattern of 2-pass printing where the even-numbered blocks and odd-numbered blocks are alternately driven; driving patterns 3-1, 3-2, and 3-3 indicate a driving pattern of 3-pass printing where the combination of blocks driven simultaneously is blocks 0, 3, 6 and 9, blocks 1, 4, 7 and 10, and blocks 2, 5, 8 and 11 respectively; and driving patterns 4-1, 4-2, 4-3 and 4-4 indicate a driving pattern of 4-pass printing where the combination of blocks driven simultaneously is blocks 0, 4 and 8, blocks 1, 5 and 9, blocks 2, 6 and 10, and blocks 3, 7 and 11 respectively.

Figure 19A:
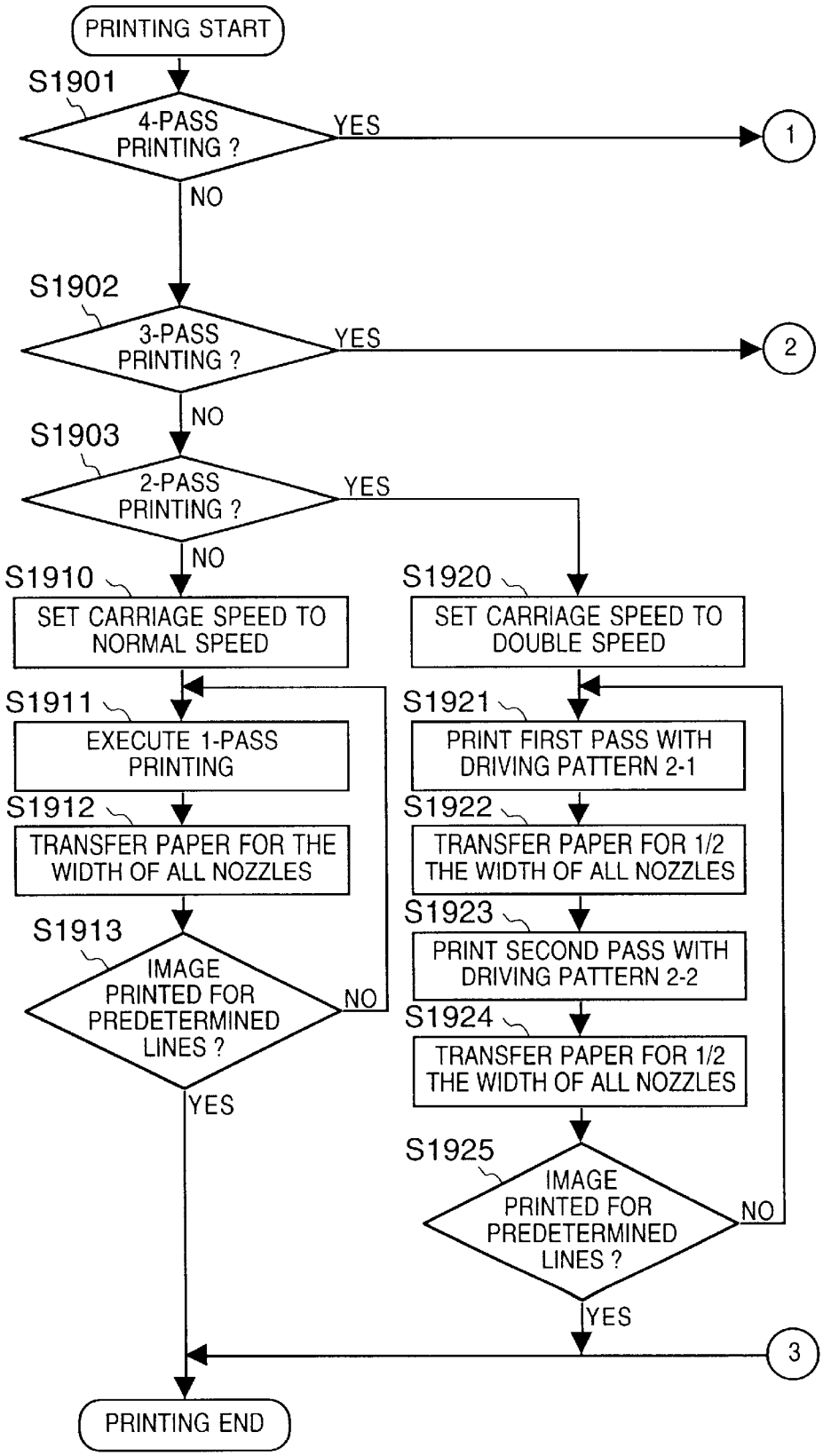
FIGS. 19A and 19B are flowcharts for performing printing operation according to the embodiment of the present invention.
Figure 19B:
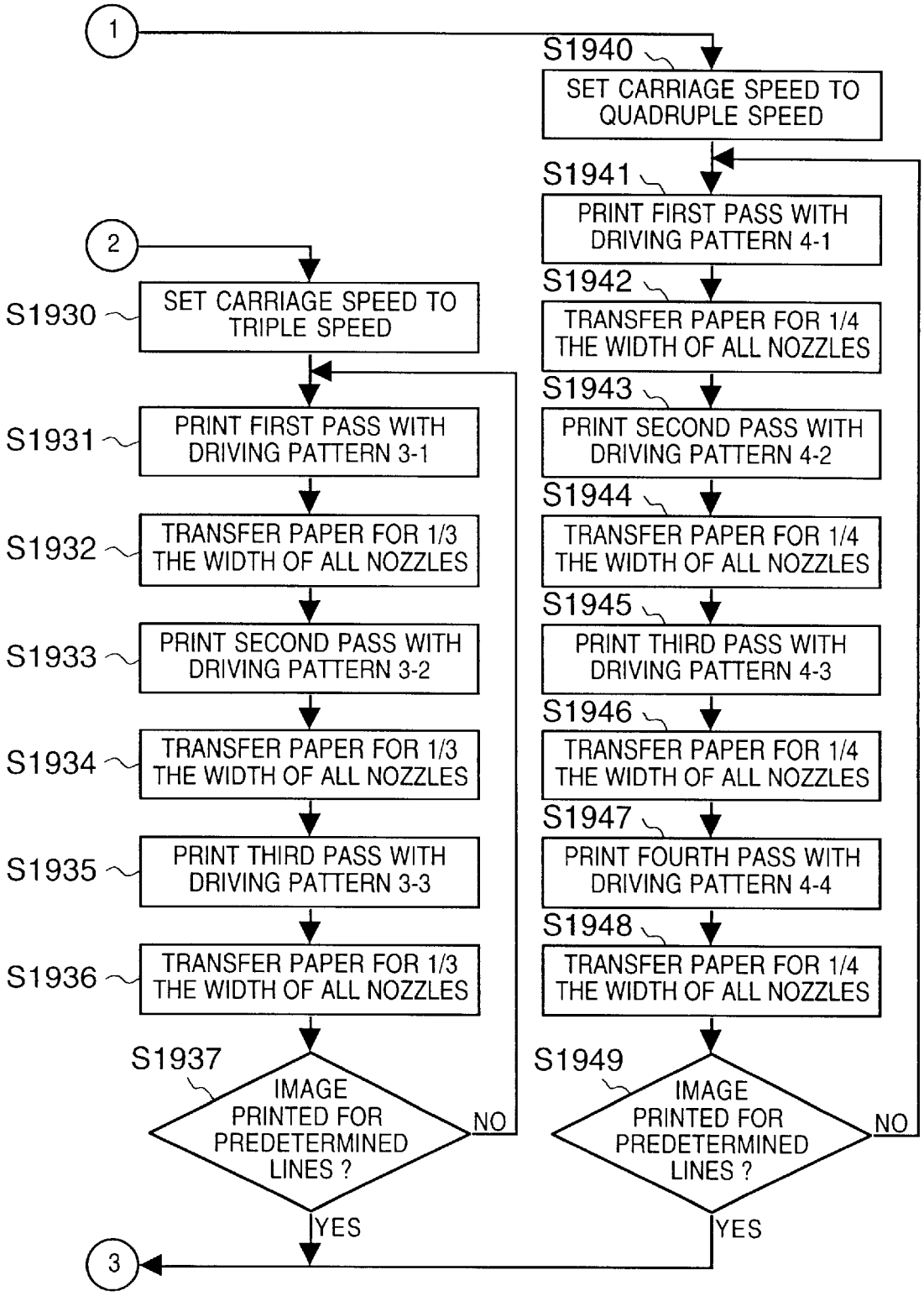

In the case of performing multi-pass printing other than 4-pass printing, to prevent printing speed from decreasing, the carriage moving speed needs to be increased as the number of passes increases. FIGS. 19A and 19B show the flowcharts executed in such cases. To be more specific, the number of passes is determined in step S1901–1093, and in 2-pass printing, the carriage speed is set to twice as fast as the carriage moving speed in 1-pass printing (step S1920), in 3-pass printing, the carriage speed is set to three times as fast as the carriage moving speed in 1-pass printing (step S1930), and in 4-pass printing, the carriage speed is set to four times as fast as the carriage moving speed in 1-pass printing (step S1940). Then, the subsequent paper transfer is repeated to print the image according to the number of passes.

In this manner, according to the present embodiment, the moving speed of the carriage is increased in correspondence with the number of passes so as not to decrease the printing speed.

Next, a printing state of the nozzle arrays in 4-pass printing according to the driving method shown in FIG. 4 is described with reference to FIGS. 10A to 10D. FIGS. 10A to 10D show driving patterns selected in each pass when a certain area of an image is printed. Reference numerals 4-1, 4-2, 4-3 and 4-4 respectively indicate the driving patterns shown in FIG. 7. Each of the small squares in FIGS. 10A to 10D corresponds to the twelve dots surrounded by the broken lines in FIG. 4. FIGS. 10A to 10D, respectively corresponding to the 1st pass to 4th pass, represent an area of 5 columns×4 groups.

In the 1st pass, 48 nozzles in the lower side of the nozzle array are used for printing. The 2nd pass of printing is performed after a print medium is moved relative to the nozzle array for a width corresponding to the 48 nozzles. Thus, nozzles to be used for printing one area are shifted upward by 48 nozzles each time one pass of printing is completed. In the case of the present embodiment, since 192 nozzles are divided into 4 passes so as to drive 48 nozzles each time, all dots can be printed in four passes without shifting the driving pattern for each pass.

Note in a case where a different number of nozzles is used or the shifting amount of driving nozzles is different for each pass, it is necessary to make adjustment by shifting the driving pattern cycle by predetermined columns for each pass.

Next, a printing state in the case of performing printing with a color printhead employed by the present embodiment is described. FIGS. 11A to 11D show driving patterns during a single scan operation at respective carriage positions. Similar to FIG. 10, each of the small squares corresponds to twelve dots. FIG. 11A shows an initial position. FIG. 11B shows a position where the printhead is shifted from the initial position in FIG. 11A to a position shifted by the width (l) of the nozzle array in the main-scanning direction. In other words, dots printed by respective nozzles in FIG. 11A are overlappingly printed by the next left nozzles in FIG. 11B. FIGS. 11C and 11D show that the carriage is further moved and dots are overlappingly printed by respective nozzles.

Herein, take notice of the boldface squares. After the nozzle array for Bk discharges Bk ink to this area, the nozzle arrays for C, M and Y respectively perform printing on the same area. However, because the blocks of nozzles driven are different for the four nozzle arrays, ink is not overlappingly discharged to one dot within a short time period. Therefore, it is possible to minimize bleeding between a plurality of inks or deviation of dots due to boundary tension of ink.

Although the description has been provided on a color printhead having a plurality of nozzle arrays of different colors, obviously, similar effects can be achieved even in a case of using a printhead having a plurality of nozzle arrays of a single color.

Figure 13:
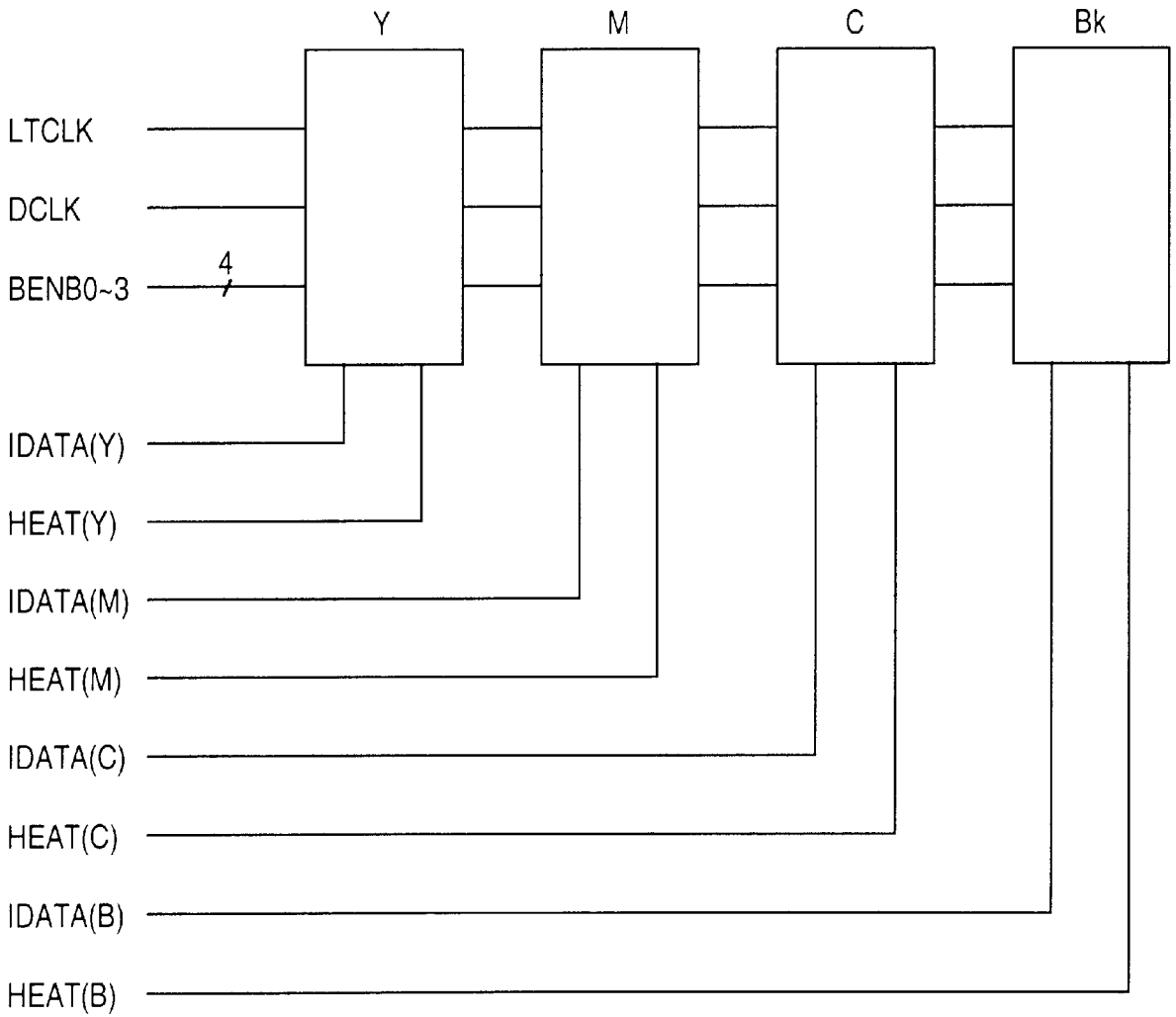
FIG. 13 is a view showing a first construction of a color printhead according to the present invention.

Note in the printhead employed by the present embodiment, all signals shown in the timing chart in FIGS. 9A and 9B, except the signal (IDATA) transmitting image data and heat signal (HEAT) specifying time for driving heaters, are common signals of four logic circuits as shown in FIG. 13. Therefore, blocks driven cannot be changed for the nozzle array provided for respective colors (Y, M, C, Bk). For this reason, the present embodiment realizes the printing state shown in FIGS. 11A to 11D by changing the distance between the nozzle arrays. Note that the distance between the nozzle arrays in FIGS. 11A to 11D is (4m+1) times (m is a positive integer) the resolution pitch in the main-scanning direction.

Figure 14:
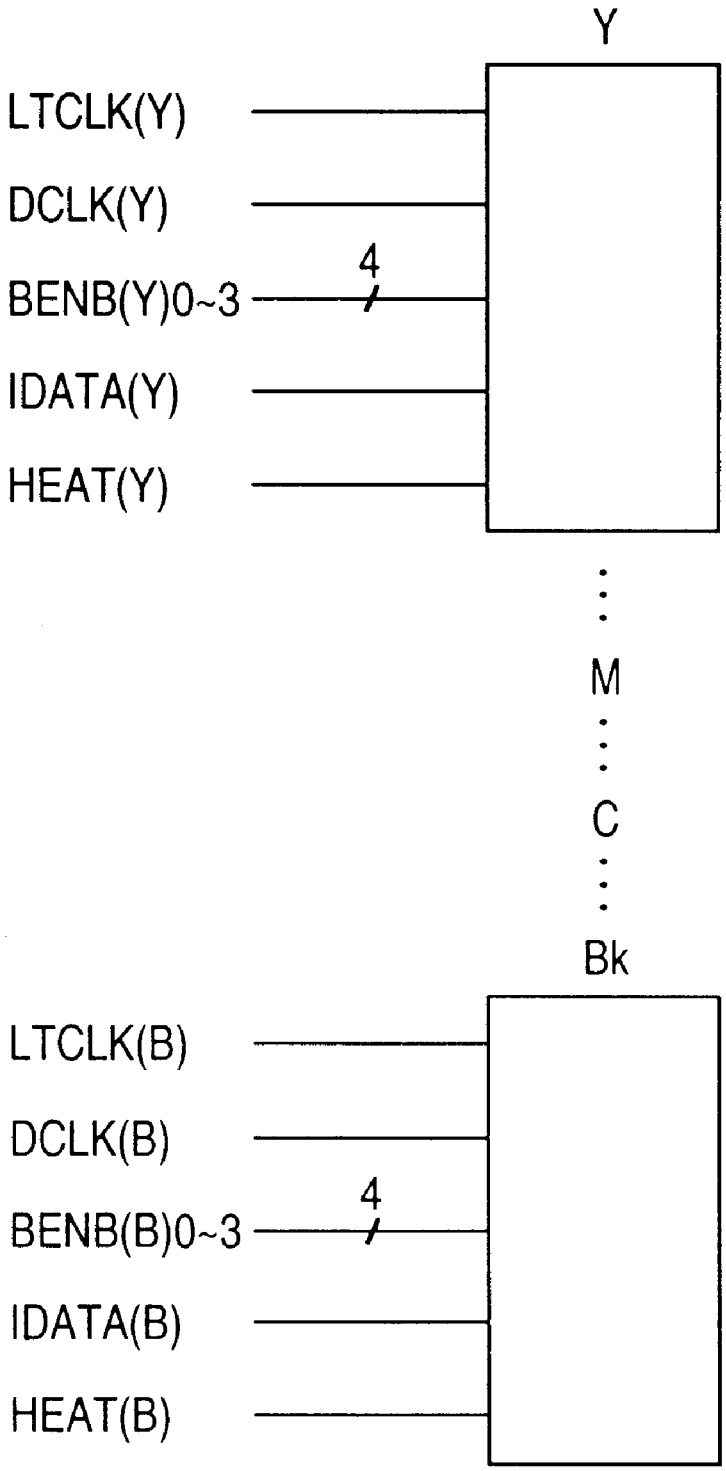
FIG. 14 is a view showing a second construction of a color printhead according to the present invention.

Although the distance between the nozzle arrays l is equal in the present embodiment, the distance may be unequal as long as the aforementioned condition is satisfied. Furthermore, in a case of the printhead shown in FIG. 14 where signals are independently supplied to each of the nozzle arrays, the distance between nozzle arrays can freely be set.

The present embodiment has described an example where a printhead having a construction shown in FIG. 8 is driven as shown in FIG. 9. However, even in a case of using a printhead having a construction shown in FIG. 15 where data for the 16 nozzles to be driven in each block is transferred for each block, the similar effects can be attained by driving the printhead as shown in FIG. 16B.

Figure 17:
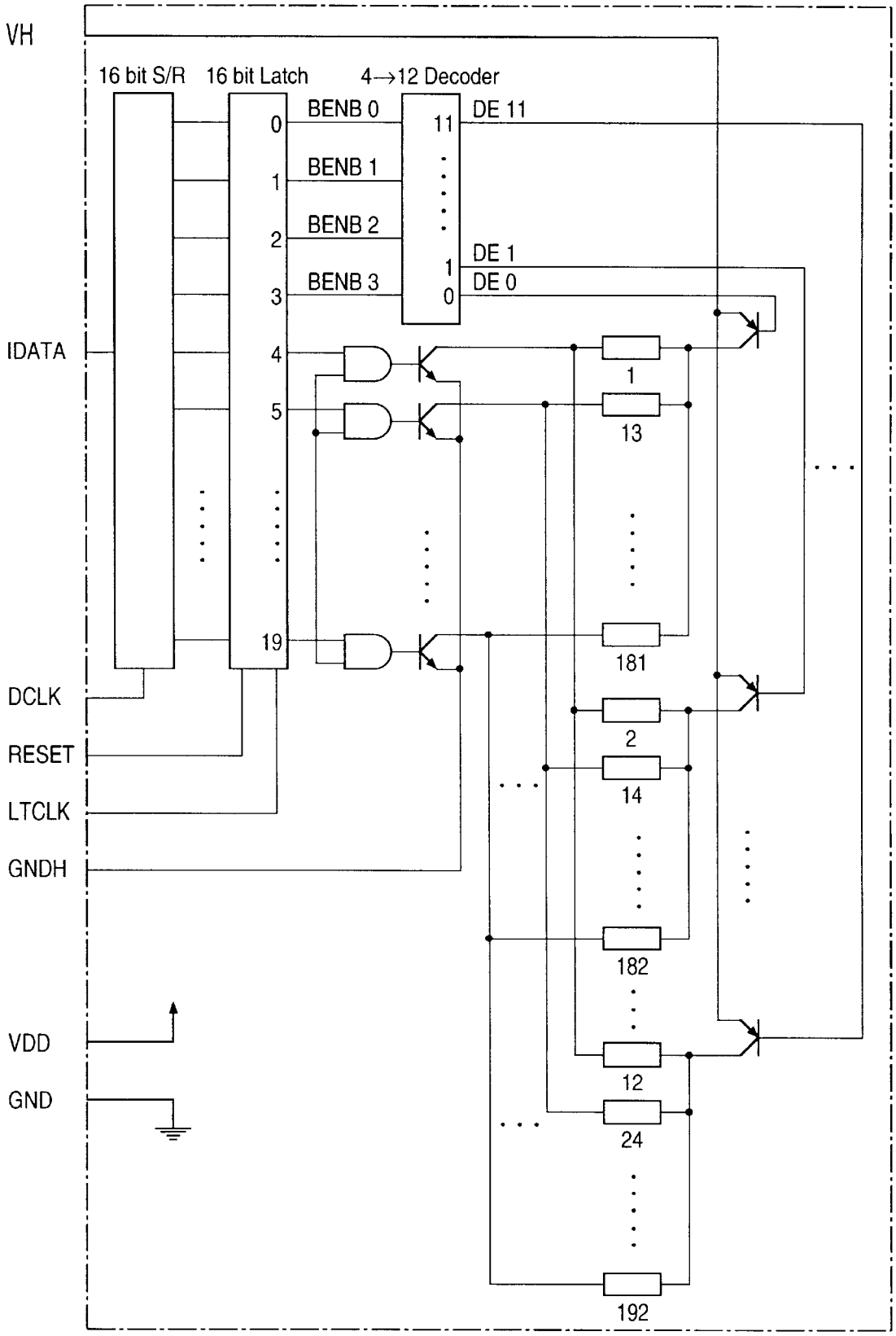
FIG. 17 is a circuit diagram showing a second variant of a logic circuit of a printhead according to the present invention.
Figure 18A:
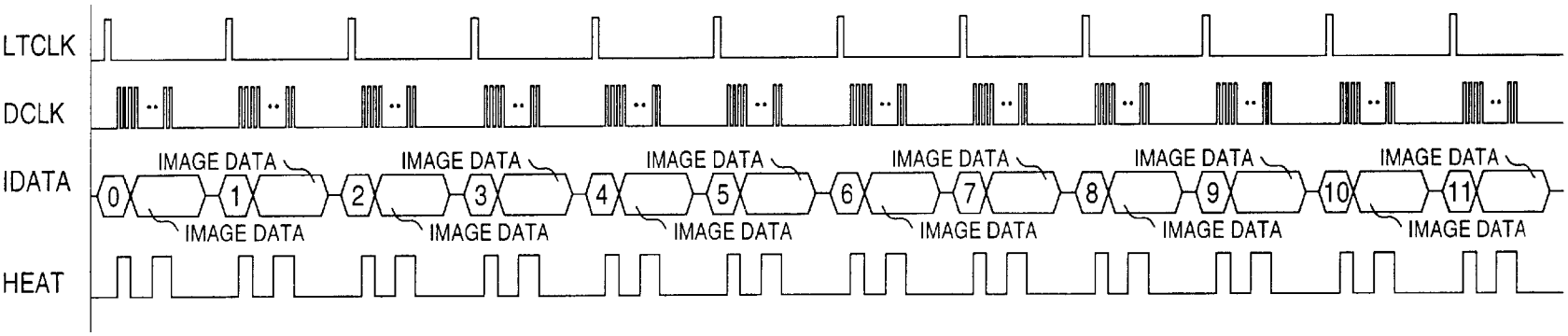
FIGS. 18A and 18B are timing charts of the logic circuit of FIG. 17.
Figure 18B:
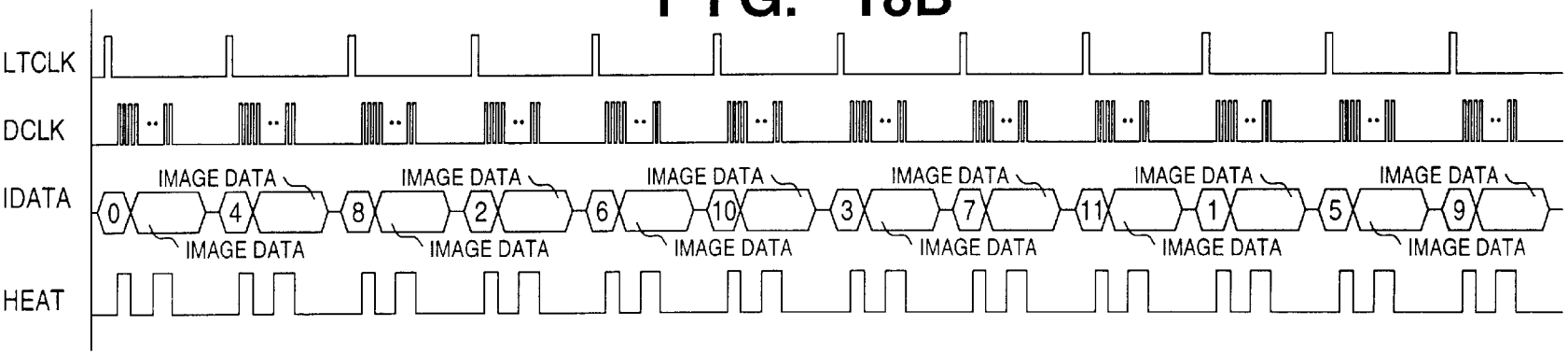

Also, in the case of using a printhead having a construction shown in FIG. 17 where block selection signals BENB0 to BENB3 are not externally inputted but data for 16 nozzles and the block number to be driven are transferred for each block, the similar effects can be attained by driving the printhead as shown in FIG. 18B.

Figure 15:
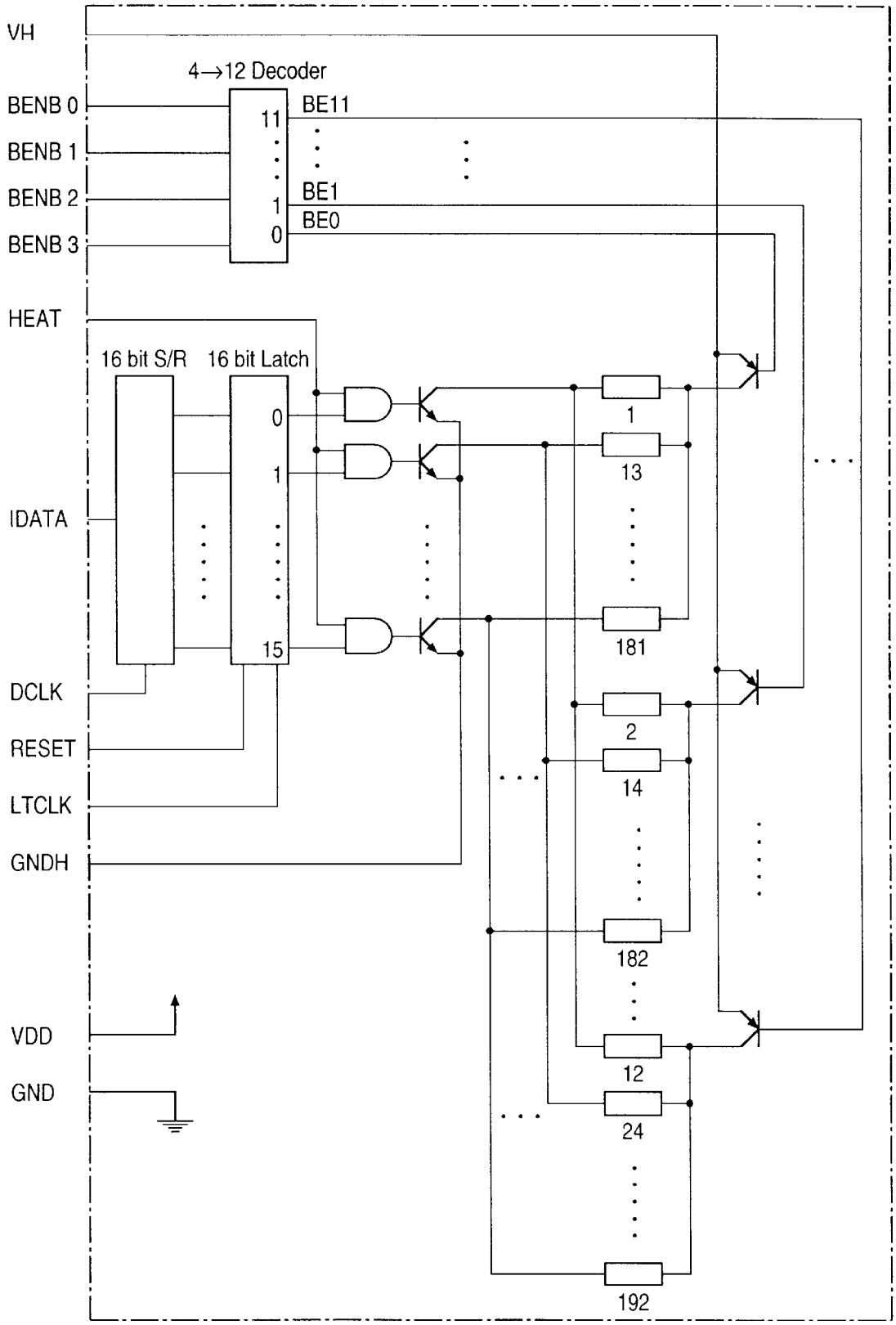
FIG. 15 is a circuit diagram showing a first variant of a logic circuit of a printhead according to the present invention.
Figure 16A:
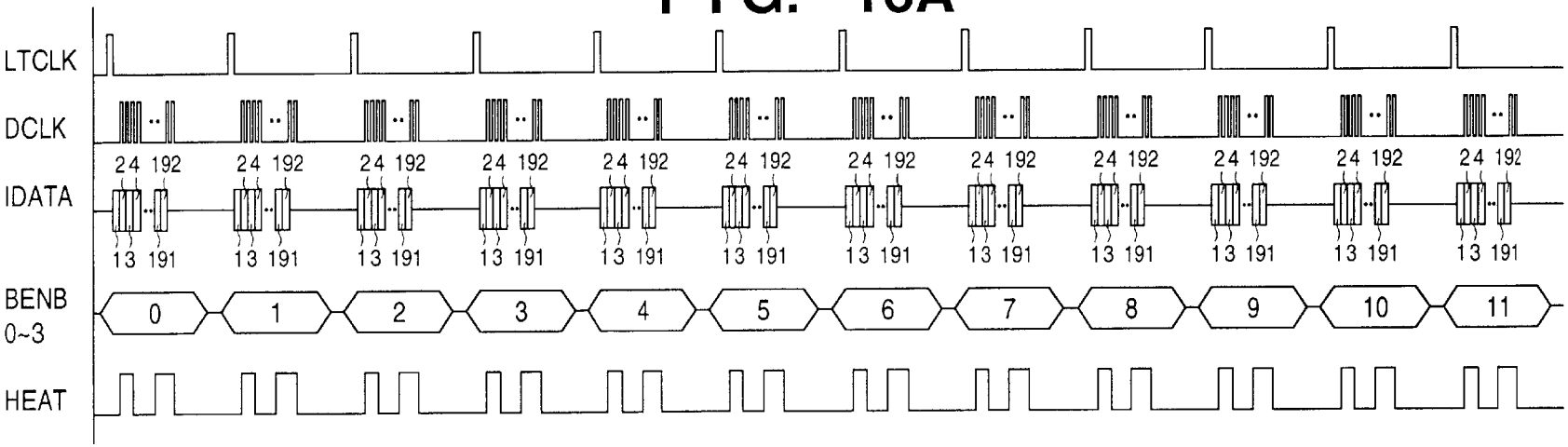
FIGS. 16A and 16B are timing charts of the logic circuit of FIG. 15.
Figure 16B:
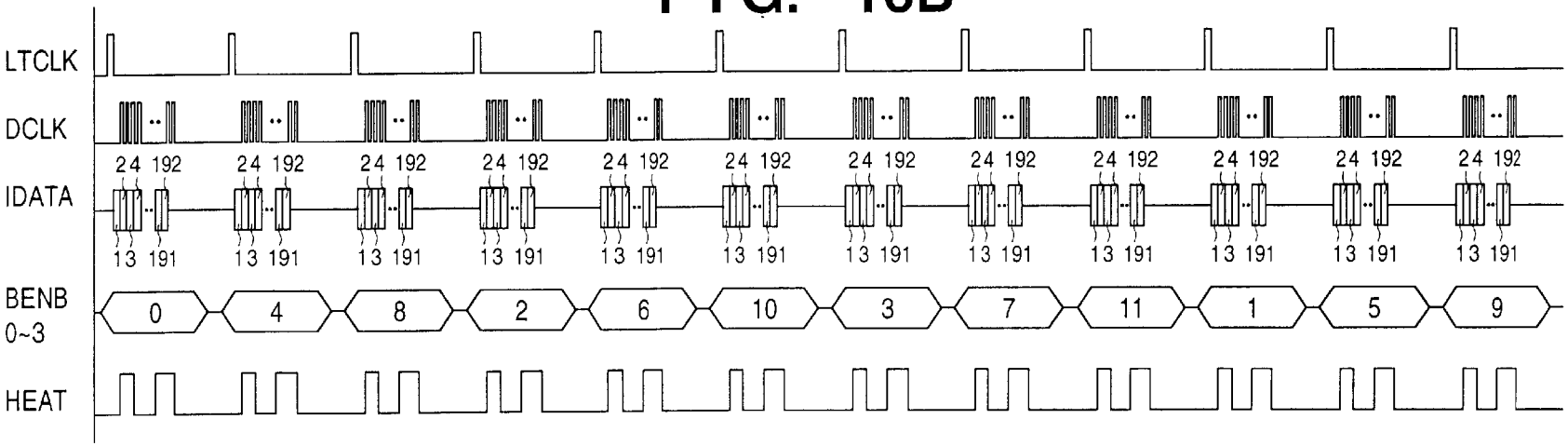

Note that FIGS. 16A and 18A are timing charts for driving the printheads shown in FIGS. 15 and 17 respectively for performing 1-pass printing.

Accordingly, since the color printhead of the present embodiment does not overlappingly print one dot within a short time period, it is possible to minimize bleeding between a plurality of inks or deviation of dots due to boundary tension of ink. Therefore, high-quality color image printing can be realized.

As has been set forth above, the printing apparatus according to the present embodiment has the following effects.

(1) By dividing a plurality of nozzles into a plurality of blocks and selecting blocks to be simultaneously driven, and by increasing the carriage moving speed in accordance with the number of passes in multi-pass printing, for instance, the carriage moving speed can be doubled when the number of blocks selected for each pass of multi-pass printing is one half of the total number of blocks. Accordingly, high-speed printing can be achieved.

(2) Because multi-pass printing and time-divisional driving are performed, the number of nozzles driven simultaneously does not increase. Therefore, an electric power necessary for driving the nozzles can be kept low, preventing an increased cost and weight of the printing apparatus due to an increased capacity of a printer power source.

(3) By virtue of multi-pass printing control and time-divisional driving control, image data to be printed is automatically thinned out. Thus, a storage device, e.g., mask ROM or the like, for obtaining sampling data for each pass is unnecessary, and the overall cost of the printing apparatus can be cut down.

(4) In color printing operation, since ink is not overlappingly discharged to one dot within a short time period, bleeding between a plurality of inks or deviation of dots due to boundary tension of ink can be minimized, and high-quality color image printing can be achieved.

Although the present embodiment describes, as an example, the configuration in which a plurality of nozzle arrays are integrated in one printhead, a printer having a plurality of printheads can also minimize bleeding between a plurality of inks or deviation of dots due to boundary tension of ink. Particularly, in a case where a printer has a plurality of printheads, since image data to be printed is supplied separately to respective printheads, the distance between nozzle arrays may be adjusted as similar to the foregoing embodiment, or the driving pattern cycle may be shifted for each head for adjustment.

Figure 12:
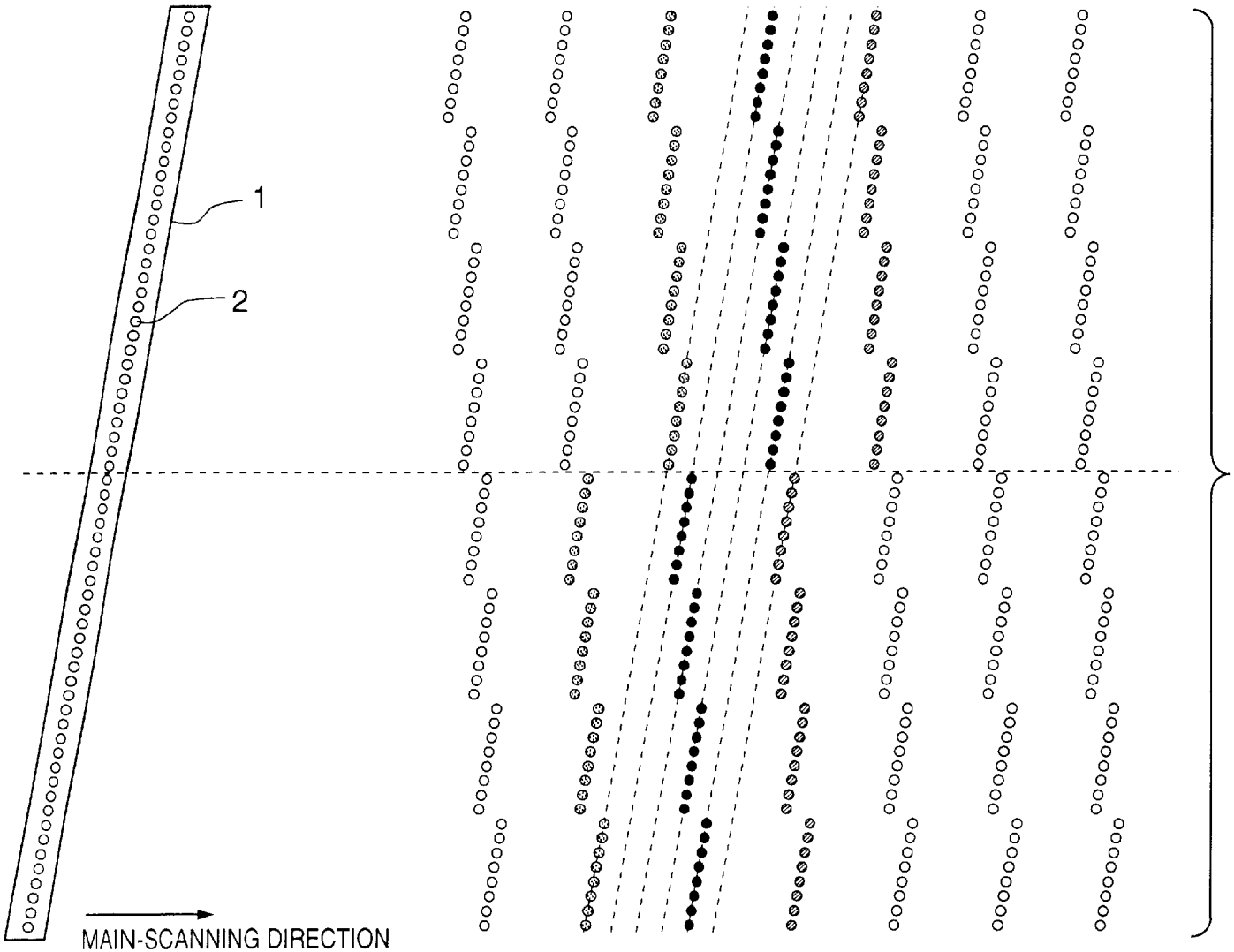
FIG. 12 is a view showing another configuration of a printhead.

Further, although the present embodiment describes a printhead where neighboring nozzles are divided into different blocks for time-divisional driving, the printing method according to the present embodiment is also applicable to a printhead where blocks of eight nozzles, arranged sequentially from the top of the drawing in FIG. 12, are simultaneously driven.

Note that in the foregoing embodiment, although the description has been provided based on the assumption that a droplet discharged by the printhead is ink and that the liquid contained in the ink tank is ink, the contents are not limited to ink. For instance, the ink tank may contain processed liquid or the like which is discharged to a print medium in order to improve the fixation or water repellency of the printed image or to improve the image quality.

Furthermore, although heaters are employed as printing elements in the above description, the present invention is not limited to this, and may employ piezoelectric devices as printing elements.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducers to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note further that excellent printing can be performed by using the conditions described in U.S. Pat. No. 4,313,124, which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a fall line type printing head having a length corresponding to the width of a maximum printing medium which can be printed by the printer, either the arrangement which satisfies the full-line length by combining a plurality of printing heads as disclosed in the above specification, or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit, but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system comprising a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments being realized by executing the program codes which are read by a computer, the present invention also includes a case where an OS (operating system) or the like working on the computer performs parts or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part or entire process in accordance with designations of the program codes and realizes functions of the above embodiments.

As is apparent, many different embodiments of the present invention can be made without departing from the spirit and scope thereof, so it is to be understood that the invention is not limited to the specific embodiments thereof, except as defined in the claims.

What is claimed is:

1. A printing apparatus for printing an image on a print medium by scanning a carriage, having at least one printhead including a plurality of printing elements, and performing multi-pass printing in which one area is printed complementarily by a plurality of scans, said printing apparatus comprising:

division means for dividing the plurality of printing elements into a plurality of blocks, each block being composed of substantially simultaneously driven printing elements;

selection means for selecting at least one different block from the plurality of blocks for each scan of the multi-pass printing;

driving means for time-divisionally driving with a unit of the at least one block selected by said selection means; and control means for controlling a moving speed of the carriage in accordance with a number of scans in the multi-pass printing.

2. The printing apparatus according to claim 1, further comprising transfer means for transferring image data to the printhead in accordance with movement of the carriage.

3. The printing apparatus according to claim 1, wherein said selection means performs selection control such that all of the plurality of blocks are selected each time printing is performed by scanning the carriage a same number of times as the number of scans in the multi-pass printing.

4. The printing apparatus according to claim 3, wherein said selection means changes a combination of blocks to be driven in each scan of the multi-pass printing such that the blocks driven are complementary to each other.

5. The printing apparatus according to claim 1, wherein neighboring printing elements belong to different blocks.

6. The printing apparatus according to claim 1, wherein said control means controls the moving speed of the carriage so as to achieve n times the speed when the number of scans in the multi-pass printing is n.

7. The printing apparatus according to claim 1, wherein when a plurality of printheads, arranged in a scanning direction of the carriage, are used and a portion printed by a first printhead is overlappingly printed by a second printhead, said selection means makes selection of blocks such that a block selected for the first printhead and a block selected for the second printhead are complementary to each other.

8. The printing apparatus according to claim 1, wherein the printhead is an ink-jet printhead which performs printing by discharging ink.

9. The printing apparatus according to claim 8, wherein the printhead discharges four colors of ink including yellow, cyan, magenta and black.

10. The printing apparatus according to claim 1, wherein said printhead is a printhead for discharging ink by utilizing heat energy, and includes heat energy transducers for generating heat energy to be applied to the ink.

11. The printing apparatus according to claim 1, wherein a number of the blocks (b) selected by said selection means is expressed by the equation, b=N/P, where N is a number of the plurality of blocks and P is a number of the plurality of scans.

12. A printing method for printing an image on a print medium by scanning a carriage, having at least one printhead including a plurality of printing elements, and performing multi-pass printing in which one area is printed complementarily by a plurality of scans, said printing method comprising the steps of:

dividing the plurality of printing elements into a plurality of blocks, each block being composed of substantially simultaneously driven printing elements;

selecting at least one different block from the plurality of blocks for each scan of the multi-pass printing;

time-divisionally driving with a unit of the selected at least one block; and controlling a moving speed of the carriage in accordance with a number of scans in the multi-pass printing.

13. The printing method according to claim 12, further comprising the step of transferring image data to the printhead in accordance with movement of the carriage.

14. The printing method according to claim 12, wherein selection control is performed such that all of the plurality of blocks are selected each time printing is performed by scanning the carriage a same number of times as the number of scans in the multi-pass printing.

15. The printing method according to claim 14, wherein a combination of blocks to be driven in each scan of the multi-pass printing is changed such that the blocks driven are complementary to each other.

16. The printing method according to claim 12, wherein neighboring printing elements belong to different blocks.

17. The printing method according to claim 11, wherein the moving speed of the carriage is controlled so as to achieve n times the speed when the number of scans in the multi-pass printing is n.

18. The printing method according to claim 12, wherein when a plurality of printheads, arranged in a scanning direction of the carriage, are used and a portion printed by a first printhead is overlappingly printed by a second printhead, block selection is made such that a block selected for the first printhead and a block selected for the second printhead are complementary to each other.

19. The printing method according to claim 12, wherein a number of the blocks (b) selected in said selecting step is expressed by the equation, b=N/P, where N is a number of the plurality of blocks and P is a number of the plurality of scans.

20. A printing apparatus for printing an image on a print medium by scanning a carriage, having at least one printhead including a plurality of printing elements, and performing multi-pass printing in which one area is printed complementarily by a plurality of scans, said printing apparatus comprising:

division means for dividing the plurality of printing elements into a plurality of blocks;

selection means for selecting at least one different block from the plurality of blocks for each scan of the multi-pass printing; and driving means for time-divisionally driving with a unit of the at least one block selected by said selection means.

21. The printing apparatus according to claim 20, wherein a number of the blocks (b) selected by said selection means is expressed by the equation, b=N/P, where N is a number of the plurality of blocks and P is a number of the plurality of scans.

22. A printing method for printing an image on a print medium by scanning a carriage, having at least one printhead including a plurality of printing elements, and performing multi-pass printing in which one area is printed complementarily by a plurality of scans, said printing method comprising the steps of:

dividing the plurality of printing elements into a plurality of blocks;

selecting at least one different block from the plurality of blocks for each scan of the multi-pass printing; and time-divisionally driving with a unit of the at least one selected block.

23. The printing method according to claim 22, wherein a number of the blocks (b) selected in said selecting step is expressed by the equation, b=N/P, where N is a number of the plurality of blocks and P is a number of the plurality of scans.

* * * * *

UNITED STATES PATENT AND TRADEMARK OFFICE

CERTIFICATE OF CORRECTION

PATENT NO. : 6,644,783 B1
DATED : November 11, 2003
INVENTOR(S) : Tsuruoka

It is certified that error appears in the above-identified patent and that said Letters Patent is hereby corrected as shown below:

Title page,
Item [56], References Cited, FOREIGN PATENT DOCUMENTS,
"JP 59-138467 8/1984" should read -- JP 59-138461 8/1984 --.

Column 8,
Line 24, "step S1901-1093" should read -- steps S1901-S1903 --.

Column 11,
Line 41, "fall line" should read -- full line --.

Column 14,
Line 38, "claim 11," should read -- claim 12, --.

Signed and Sealed this

Twenty-ninth Day of June, 2004

JON W. DUDAS
*Acting Director of the United States Patent and Trademark Office*